US009815221B1

(12) United States Patent
Warnock

(10) Patent No.: US 9,815,221 B1
(45) Date of Patent: Nov. 14, 2017

(54) JOLLYING AND JIGGERING CAROUSEL

(71) Applicant: Jeffrey Warnock, San Francisco, CA (US)

(72) Inventor: Jeffrey Warnock, San Francisco, CA (US)

( * ) Notice: Subject to any disclaimer, the term of this patent is extended or adjusted under 35 U.S.C. 154(b) by 545 days.

(21) Appl. No.: 14/510,551

(22) Filed: Oct. 9, 2014

(51) Int. Cl.
*B28B 1/02* (2006.01)

(52) U.S. Cl.
CPC ..... *B28B 1/02* (2013.01); *B28B 1/025* (2013.01)

(58) Field of Classification Search
CPC ..... B28B 1/02; B28B 1/025
USPC ..... 269/83, 288, 57; 264/8, 114, 311, 310
See application file for complete search history.

(56) References Cited

U.S. PATENT DOCUMENTS 1,430,363 A * 9/1922 Dolley ..... B28B 1/02 264/310
2,293,070 A * 8/1942 Miller ..... B28B 1/02 264/297.6
2012/0216659 A1* 8/2012 Bailey ..... B28B 1/025 82/166

OTHER PUBLICATIONS

Axner, "Axner Power Arm", pp. 1-3 (retrieved Jan. 9, 2015 from www.axner.com).
Axner, "Axner Power Arm: Assembly Instructions", pp. 1-2 (retrieved Jan. 9, 2015 from www.axner.com).
Mussi, Susan "Ceramic-Pottery Dictionary", p. 1 (retrieved May 15, 2014 from http://ceramicdictionary.com/en/j/653/jiggering-and-jollying).
Gladstone, "G122 Jigger and Jolly Machine", pp. 1-2 (retrieved Jan. 9, 2015 from www.gladstoneengineering.com).
Peterson, Beth, "Pottery", About.com, p. 1 (retrieved Jan. 9, 2015 from http://pottery.about.com/od/potteryglossarygi/g/jiggers.htm).
"Jigger Machine Principles and Construction", pp. 1-9 (retrieved Jan. 9, 2015 from http://www.nzdl.org/cgi-bin/library.cgi?e=d -00000-00---off-0hdl--00-0----0-10-0---0---0direct-10------4------0-1l--11-en-50---20-about---00-0-1-00-0-0-11-1-0utfZz-8-00 &cl=CL1.6&d=HASHad1f112965c45034958718.5&gt=1).
Jones, Bill, "Throwing Bats", Tools of the Trade, Pottery Making Illustrated, May/Jun. 2012, pp. 8-9.

* cited by examiner

*Primary Examiner* — Alison L Hindenlang
*Assistant Examiner* — Cedrick S Williams
(74) *Attorney, Agent, or Firm* — Raubvogel Law Office

(57) ABSTRACT

A system may be used with a pottery wheel to facilitate the shaping of a workpiece. The system may have a support assembly coupled to a rotatable wheel of the pottery wheel, and a template holder that holds a template relative to the wheel. The support assembly may have a rotary coupling to which the template holder is coupled; thus, the template holder may be used to keep the template stationary as the wheel, workpiece, and support assembly rotate. The template may be used for jiggering and/or jollying, and may have a plate with a shaping surface that contacts the workpiece during relative rotation to provide the desired contour. The template may have a plate that is insertable into a slot of the template; the template may be retained by the template holder at multiple displacements from the rotatable wheel.

20 Claims, 14 Drawing Sheets

JOLLYING AND JIGGERING CAROUSEL

TECHNICAL FIELD

The present disclosure relates to systems and methods for facilitating the creation of pottery, and more specifically, to improved jiggering and jollying systems and methods.

BACKGROUND

The art of pottery has been practiced for millennia. A workpiece, often made of clay, may be worked into a desired shape and then "fired," or baked at high temperature, to harden the workpiece in the desired shape. Modern potters have a variety of tools that facilitate the creation of designs such as pots, tableware, and decorative pieces. Many potters use a pottery wheel to rotate each workpiece to facilitate the creation of axially symmetrical patterns. In this manner, bowls, plates, pitchers, and other pieces with round and/or annular cross-sectional shapes can be created with relative ease.

Jiggering and jollying are processes by which a template may be applied to the exterior or interior of a workpiece, respectively, to, obtain a desired contoured shape. Jiggering and jollying can help the potter more rapidly shape each workpiece and obtain a more consistent result.

Unfortunately, known jiggering and jollying systems are deficient in many respects. Some are cumbersome or otherwise difficult to use. For example, some require the performance of several steps to secure a template to a fixture, and then position and lock the fixture in place. Once locked in place, many known jiggering and/or jollying systems lack the rigidity to keep the template in a constant position relative to the workpiece. This may produce irregularities in the contoured surface and fail to save the potter time and effort. There is a need in the art for jiggering and/or jollying systems that remedy the shortcomings of known systems.

SUMMARY

Various embodiments of the technology described herein provide improved systems and/or methods for the shaping of pottery. In some embodiments, a shaping system may be coupled to the rotating wheel of a pottery wheel. The shaping system may include various components that cooperate to hold a template over a workpiece in such a manner that, as the rotating wheel rotates, the template can be kept stationary (non-rotating). The template may be placed in contact with a rotating workpiece on the rotating wheel, or on a mold or bat coupled to the rotating wheel, to provide the desired contour in the workpiece as the workpiece rotates.

In some embodiments, the shaping system may include a support assembly and a template holder. The support assembly may support the template holder above the rotating wheel. The template holder may have a template interface that retains a template. The support assembly may have a rotary coupling such as a ring bearing that permits the template holder to remain stationary while the support assembly rotates with the rotatable wheel. Thus, the template can be held relatively stationary against the rotating surface of the workpiece to define a contour on the workpiece with the shape of the shaping edge of the template.

The support assembly may optionally take the form of a carousel with a carousel base secured to the rotatable wheel and a carousel fixture that extends above the rotatable wheel to the template holder. The carousel base may be discoid, and may be secured to the rotatable wheel through the use of one or more coupling features such as holes sized to receive bat pins commonly used to couple a bat or mold to the rotatable wheel. The carousel base may have coupling features to enable coupling of a bat or mold to the carousel base; such coupling features may also be holes that receive bat pins. Thus, a mold or bat may be secured to the carousel base in place of the rotatable wheel.

The carousel fixture may have a number of support columns that extend upward from the carousel base. The rotary coupling may have the form of a ring bearing secured to the top ends of the support columns. The template holder may be secured to the ring bearing in a manner that enables the template holder to rotate relative to the carousel fixture.

The template holder may have a template interface that retains the template. The template interface may have a radial brace that extends radially, relative to the rotatable wheel, and an axial brace that extends parallel to the axis of the rotatable wheel. The template may have a plate on which the shaping surface is provided. The plate may also have a registration edge that extends axially when the template is retained by the template interface. The radial brace may have a radial brace slot through which the plate is insertable. The axial brace may have an axial brace slot that receives the registration edge of the plate to help stabilize the plate.

The template may optionally have an adjustable depth stop that controls the depth to which the plate is insertable through the radial brace slot. The adjustable depth stop may rest on the radial brace, and may be securable to the plate in multiple relative positions to allow the template to be retained by the template interface in any of a plurality of displacements relative to the workpiece.

In order to use the shaping system to facilitate the shaping of a workpiece, the potter may first couple the carousel base to the rotatable wheel. The potter may then couple a mold or bat, as desired, to the carousel base and place the workpiece on the mold or bat. The workpiece may be prepared, for example, by wetting it to help it adhere to the mold or bat. Then, the potter may secure the carousel fixture to the carousel base. The potter may use the template interface to retain the template at the desired position relative to the workpiece. The potter may then engage rotation of the rotatable wheel and contact the workpiece with the template to define the desired contour in the workpiece. Once the desired contour has been obtained, the potter may trim away excess clay and disassemble the shaping system as needed to remove mold or bat and/or the workpiece for further processing.

BRIEF DESCRIPTION OF THE IMAGES

The accompanying drawings illustrate several embodiments. Together with the description, they serve to explain the principles of the embodiments. One skilled in the art will recognize that the particular embodiments illustrated in the drawings are merely exemplary, and are not intended to limit scope.

DETAILED DESCRIPTION

According to various embodiments, a shaping system is used to facilitate the creation of radially symmetrical contoured surfaces on pottery workpieces. The shaping system may be used in conjunction with known pottery devices such as a pottery wheel.

In the description provided herein, the following terms are used:

- A bat is an object, typically in the form of a thin slab of wood, plaster, or plastic, that can be attached to the rotating wheel of a pottery wheel to support the workpiece.
- A carousel is device with a generally cylindrical shape that is rotatable about the axis of the cylinder.
- Coupling two items relates to mechanically connecting the two items together in a manner that restricts, in at least one dimension, rotation and/or translation between the two items.
- Jiggering is a process by which an exterior contour on a workpiece can be defined through the use of a template.
- Jollying is a process by which an interior contour on a workpiece can be defined through the use of a template.
- A mold is an object with a nonplanar shape against which a workpiece can be shaped to form a corresponding nonplanar shape in the workpiece.
- A pottery wheel is any device with a rotatable surface on which a workpiece can be placed to facilitate shaping.
- Shaping is the process of defining a desired shape in a workpiece.
- A template is an object that can be brought into contact with a workpiece to provide a contour of a desired shape.
- A rotatable wheel is the rotatable element of a pottery wheel on which the rotatable surface is located.
- A workpiece is a portion of formable material.

In one embodiment, a shaping system may be coupled to the rotatable wheel of a pottery wheel. The shaping system may be used to hold a template, such as a jiggering template or a jollying template, in the proper position relative to the workpiece. Once example of such a shaping system will be shown and described in connection with FIG. 1.

Shaping System Configuration

Figure 1:
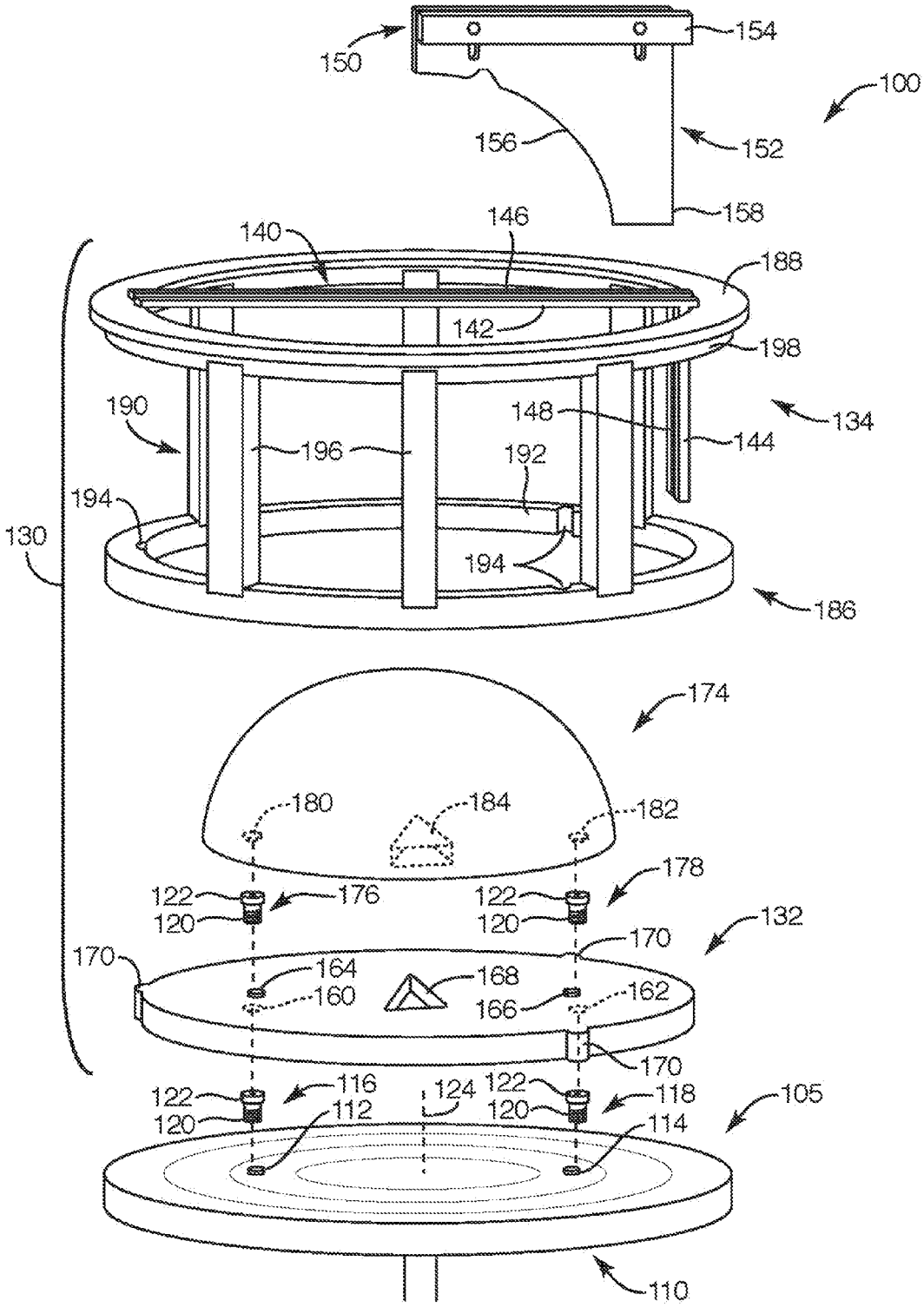
FIG. 1 is an exploded, perspective view of a shaping system according to one embodiment.

Referring to FIG. 1, a perspective view illustrates a shaping system, or system 100 according to one embodiment of the invention. The shaping system 100 may be securable to a pottery wheel 105, and more specifically, to a rotatable wheel 110 of the pottery wheel 105.

The rotatable wheel 110 may have one or more coupling features that facilitate the coupling of items such as bats and/or molds to the rotatable wheel 110. In some embodiments, the rotatable wheel 110 may be part of a pottery wheel of a known design, with coupling features configured to enable the rotatable wheel 110 to receive mold and/or bat of a type commonly used in the art.

As shown in FIG. 1, the coupling features may include a first hole 112 and a second hole 114. The first hole 112 and the second hole 114 may each be configured to receive a bat pin of a type known in the art, such as a first bat pin 116 and a second bat pin 118. The first bat pin 116 and the second bat pin 118 may each, for example, have a proximal end 120 and a distal end 122. The first hole 112 and the second hole 114 may be shaped to receive the proximal ends 120 of the first bat pin 116 and the second bat pin 118, respectively. In some embodiments, the proximal ends 120 may be threaded or otherwise shaped to be retained within the first hole 112 and the second hole 114. Thus, the first hole 112 and the second hole 114 may have threading or other corresponding features that cooperate with the proximal ends 120 of the first bat pin 116 and the second bat pin 118 to retain the proximal ends 120 within the first hole 112 and the second hole 114.

The distal ends 122 of the first bat pin 116 and the second bat pin 118 may also have features that facilitate retention. If the proximal ends 120 are threaded, it may be desirable for the distal ends 122 to instead utilize retention features that do not require relative rotation in order to provide engagement. For example, the proximal ends 120 may optionally have surface texturing, knurling, and/or other features that promote frictional engagement with the holes into which they will be received.

The rotatable wheel 110 may have an axis 124, which may be the axis of rotation. An "axial direction" may be any direction parallel to the axis 124, and a "radial direction" may be any direction perpendicular to the axis 124.

The system 100 may include a support assembly 130, a template holder 140, and a template 150. The support assembly 130 may be coupled to the rotatable wheel 110, for example, through the use of the first hole 112, the second hole 114, the first bat pin 116, and the second bat pin 118. The support assembly 130 may serve to maintain the template holder 140 in an elevated position over the rotatable wheel 110 in order to facilitate positioning of the template 150 in a desired position relative to the rotatable wheel 110.

The support assembly 130 may take the form of a carousel that can be securely attached to the rotatable wheel 110 such that the support assembly 130 rotates with the rotatable wheel 110 and thence, with the workpiece (not shown in FIG. 1). The support assembly 130 may have a base 132 and a fixture 134, which may be a carousel base and a carousel fixture, respectively. The base 132 may be coupled to the rotatable wheel 110 and the fixture 134 may be coupled to the base 132.

The base 132 may optionally be coupled to the rotatable wheel 110 in a manner similar to that of a conventional bat or mold. Thus, the base 132 may have coupling features designed to interface with the first bat pin 116 and the second bat pin 118. For example, these coupling features may take the form of a first hole 160 and a second hole 162 that are spaced apart in a manner similar to that of the first hole 112 and the second hole 114 of the rotatable wheel 110. The first hole 160 and the second hole 162 may have retention features, such as surface texturing, knurling, and/or threading, that cooperate with the distal ends 122 of the first bat pin 116 and the second bat pin 118 to help retain the distal ends 122 within the first hole 160 and the second hole 162.

Further, the base 132 may have coupling features that facilitate coupling of the base 132 with other items such as a bat and/or a mold, as will be shown subsequently. If desired, such coupling features may be designed to couple the base 132 with known bat and/or mold designs, such as those made for use with conventional pottery wheels.

As shown in FIG. 1, these coupling features of the base 132 may include a first hole 164, a second hole 166, and/or a central aperture 168. The first hole 164 and the second hole 166 may function in conjunction with a first bat pin 176 and a second bat pin 178, which may be similar in design to the first bat pin 116 and the second bat pin 118 that can be used to couple the base 132 to the rotatable wheel 110.

Thus, the first bat pin 176 and the second bat pin 178 may each have a proximal end 120 and a distal end 122 like those of the first bat pin 116 and the second bat pin 118. The proximal ends 120 of the first bat pin 176 and the second bat pin 178 may be received within the first hole 164 and the second hole 166. Like the first hole 112 and the second hole 114, the first hole 164 and the second hole 166 may optionally be threaded or otherwise configured to retain the proximal ends 120 of the first bat pin 176 and the second bat pin 178.

The central aperture 168 may be used in the addition to or in the alternative to the first hole 164 and/or the second hole 166. In some embodiments, the central aperture 168 may receive a key or other protuberance (not shown) on the underside of a bat or mold. The central aperture 168 may have a non-circular shape (for example, the triangular shape shown in FIG. 1), and the key or other protuberance may have a corresponding shape that is receivable within the non-circular shape of the central aperture 168. The non-circular shape may ensure that bat or mold rotates along with the base 132.

The base 132 may also have one or more alignment features that facilitate coupling of the base 132 with the fixture 134. According to some examples, the alignment features may be used to ensure that the fixture 134 rotates along with the base 132. Thus, as shown in FIG. 1, the alignment features may be alignment keys 170 that protrude outward from the periphery of the base 132 to engage corresponding features of the fixture 134, which will be described subsequently.

As mentioned previously, the coupling features of the base 132 may be designed to enable the base 132 to receive a mold or bat. By way of example, a mold 174 is illustrated in FIG. 1. The mold 174 may be of a type known in the art, if desired. The mold 174 may have coupling features designed to facilitate coupling of the mold 174 to a rotatable wheel such as the rotatable wheel 110. The same coupling features may be used to couple the mold 174 to the base 132.

Specifically, the mold 174 may have coupling features in the form of a first hole 180, a second hole 182, and a central key 184. The first hole 180 and the second hole 182 may be shaped to receive the distal ends 122 of the first bat pin 176 and the second bat pin 178, respectively. The first hole 180 and the second hole 182 may include retention features designed to receive the distal ends 122, as discussed in connection with the first hole 160 and the second hole 162. The central key 184 may have a noncircular shape that corresponds to that of the central aperture 168, and may thus be triangular shaped in the embodiment of FIG. 1. The central key 184 may be sized to fit within the central aperture 168.

The fixture 134 may include various features that help to position the template holder 140 at the desired elevation over the rotatable wheel 110. In some embodiments, the fixture 134 may have a support ring 186 designed to be coupled to the base 132, a rotary coupling 188 attached to the template holder 140 in a manner that enables rotation of the template holder 140 relative to the fixture 134, and a support structure 190 that supports the rotary coupling 188 at the desired elevation over the support ring 186.

As shown, the support ring 186 may have an interior surface 192, which may be sized to encompass the periphery of the base 132. The support ring 186 may also have alignment features that cooperate with those of the base 132 to cause the fixture 134 to rotate with the base 132. The alignment features of the support ring 186 may include alignment sockets 194 formed in the interior surface 192 to receive the alignment keys 170 of the base 132.

The support structure 190 may include a plurality of support columns 196 and a distal ring 198. The support columns 196 may be distributed about the circumference of the support structure 190, and may be secured, at their proximal ends, to the support ring 186 and, at their distal ends, to the distal ring 198. The distal ring 198 may be secured to the underside of the rotary coupling 188. If desired, the spaces between the support columns 196 may be occupied by a wire mesh or other semi-permeable barrier that provide structural support and/or protection for the potter's hands while still enabling the potter to view the interior of the fixture 134 by looking between the support columns 196.

The rotary coupling 188 may, in some embodiments, take the form of a ring bearing, which may have a top surface that is rotatable relative to its bottom surface. The rotary coupling 188 may be any type of ring bearing known in the art, or any other type of connector that enables relative rotation between two types. The template holder 140 may be secured to the top surface and/or the interior surface of the rotary coupling 188.

The template holder 140 may be designed to hold the template 150 at the desired elevation above the rotatable wheel 110. The template holder 140 may have a radial brace 142 extending along the radial direction, relative to the rotatable wheel 110, and an axial brace 144, extending along the axial direction, relative to the rotatable wheel 110. The radial brace 142 and the axial brace 144 may thus be at right angles to each other. The radial brace 142 may extend across the full diameter of the rotary coupling 188 and may be secured, for stability, to both sides of the rotary coupling 188.

The radial brace 142 may have a radial brace slot 146 extending generally along its length. Similarly, the axial brace 144 may have an axial brace slot 148 extending generally along its length. The radial brace 142 and the axial brace 144 may cooperate to define a template interface that retains the template 150 at the desired position. This may be done via interaction of the template 150 with the radial brace slot 146 and the axial brace slot 148, as will be described subsequently.

The template 150 may have a plate 152 and an adjustable depth stop 154 secured to the plate. The plate 152 may have a contouring edge 156, which may be shaped to provide the desired contour in the workpiece. As shown in FIG. 1, the template 150 may be a jiggering template; thus, the contouring edge 156 may be oriented toward the axis 124 of the rotatable wheel 110. The plate 152 may also have a registration edge 158 that can be retained by the template holder 140 to provide additional stability.

More specifically, the template 150 may be retained by the template holder 140, or more specifically, by the template interface of the template holder 140, by inserting the plate 152 into the radial brace slot 146 of the axial brace 144. The plate 152 may be inserted until the adjustable depth stop 154 rests on the top surface of the radial brace 142. The registration edge 158 may be inserted into the axial brace slot 148, either as the plate 152 is inserted into the radial brace slot 146, or afterward (for example, by moving the template 150 radially along the radial brace 142 until the registration edge 158 is received within the axial brace slot 148).

Thus, the adjustable depth stop 154 may control the depth at which the plate 152 resides relative to the template holder 140. The radial brace slot 146 may retain the plate 152 to keep the plate 152 in place relative to the template holder 140, and the axial brace slot 148 may additionally retain the plate 152 to provide additional stability. More specifically, the engagement of the registration edge 158 with the axial brace slot 148 may help to ensure that the plate 152 remains substantially vertical as the contouring edge 156 engages the workpiece. The position of the adjustable depth stop 154 relative to the plate 152 may be adjusted to enable adjustment of the depth to which the plate 152 is insertable through the radial brace slot 146, as will be discussed subsequently in connection with FIGS. 9A and 9B.

Workpiece Shaping

Figure 2:
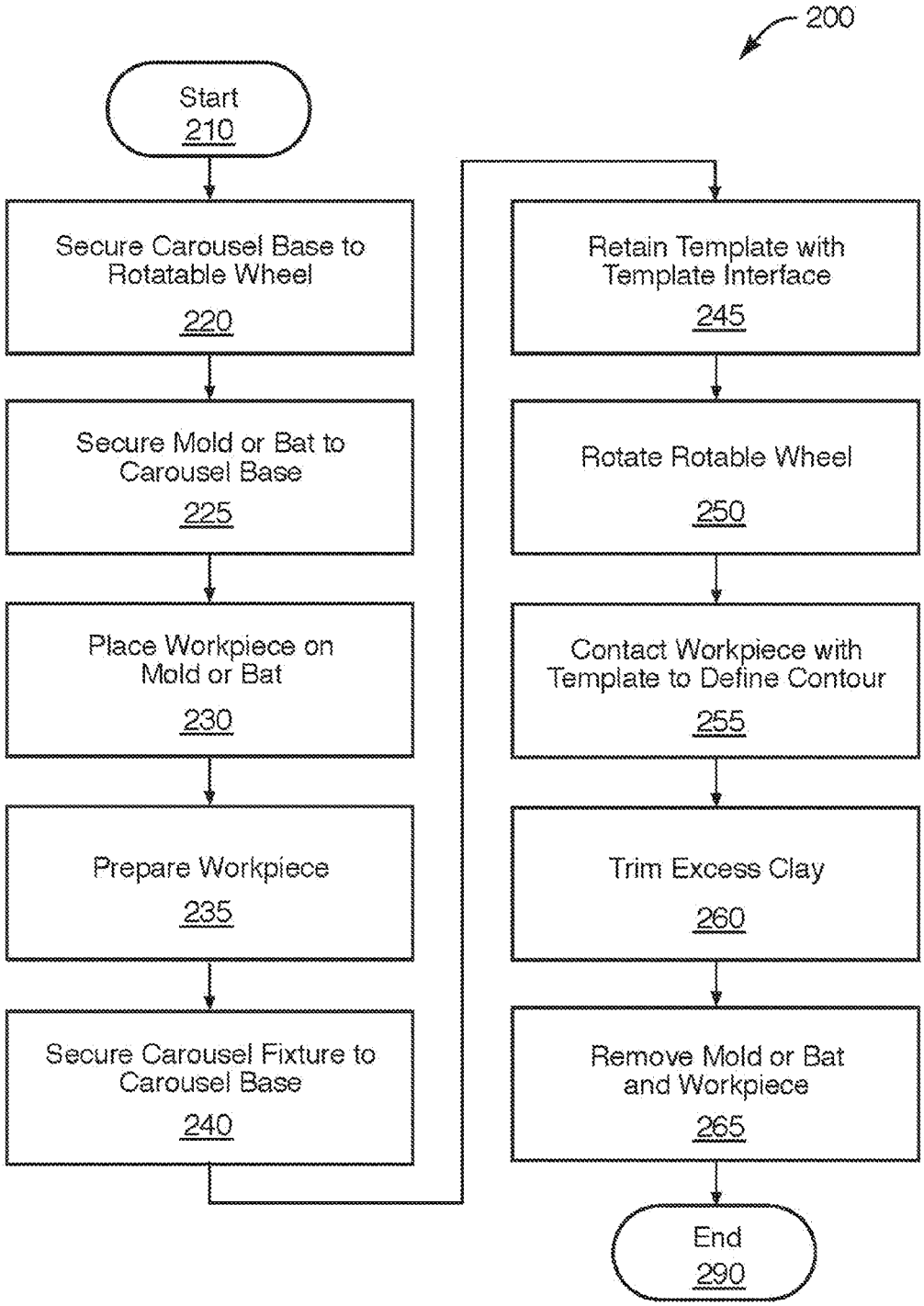
FIG. 2 is a flow diagram illustrating a method of shaping a workpiece according to one embodiment.

Referring to FIG. 2, a flow diagram illustrates a method 200 for shaping a workpiece, according to one embodiment. The following description of the method 200 will be provided with reference to the system 100 of FIG. 1. However, in alternative embodiments, the method 200 may be performed with a variety of differently-configured systems. Further, in alternative embodiments, the system 100 may be used to carry out a variety of methods in addition to or in place of the method 200 of FIG. 2. The various steps of the method 200 will be shown and described in connection with FIGS. 3-8, as follows.

Figure 3:
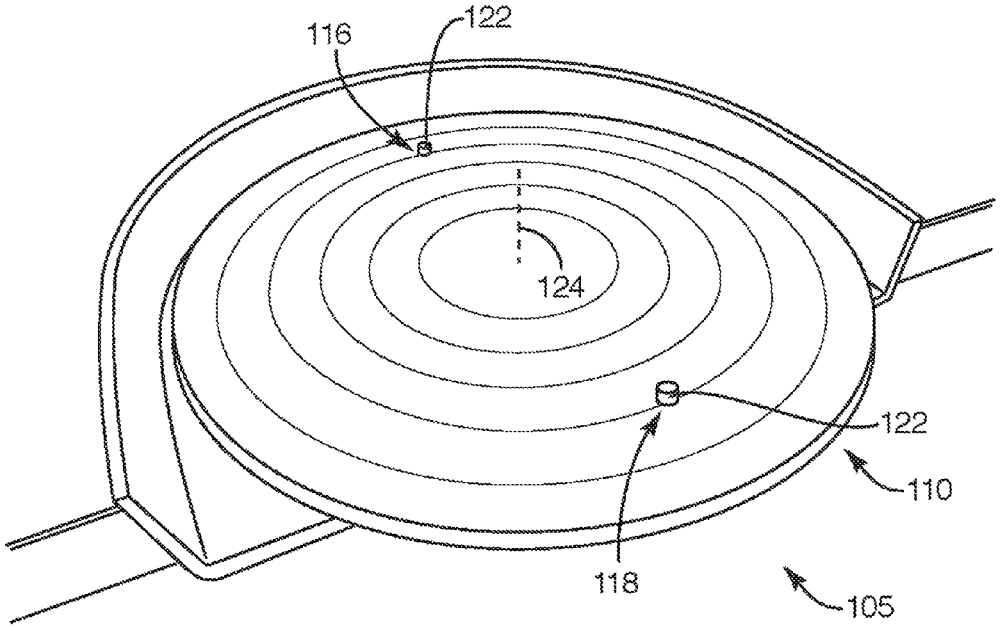
FIG. 3 is a perspective view of a pottery wheel prior to placement of a shaping system.

As shown, the method 200 may start 210 with the pottery wheel 105 in a condition as shown in FIG. 3, in which the system 100 is not yet coupled to the pottery wheel 105. As shown in FIG. 3, the first bat pin 116 may be inserted into the first hole 112 and the second bat pin 118 may be inserted into the second hole 114. The distal ends 122 of the first bat pin 116 and the second bat pin 118 may be left exposed above the surface of the rotatable wheel 110.

Returning to FIG. 2, in a step 220, the base 132 may be secured to the rotatable wheel 110. This may entail aligning the distal ends 122 of the first bat pin 116 and the second bat pin 118 with the first hole 160 and the second hole 162 of the base 132, as shown in FIG. 1, and then moving the base 132 into engagement with the rotatable wheel 110 such that the distal end 122 of the first bat pin 116 enters the first hole 160, and the distal end 122 of the second bat pin 118 enters the second hole 162.

Figure 4:
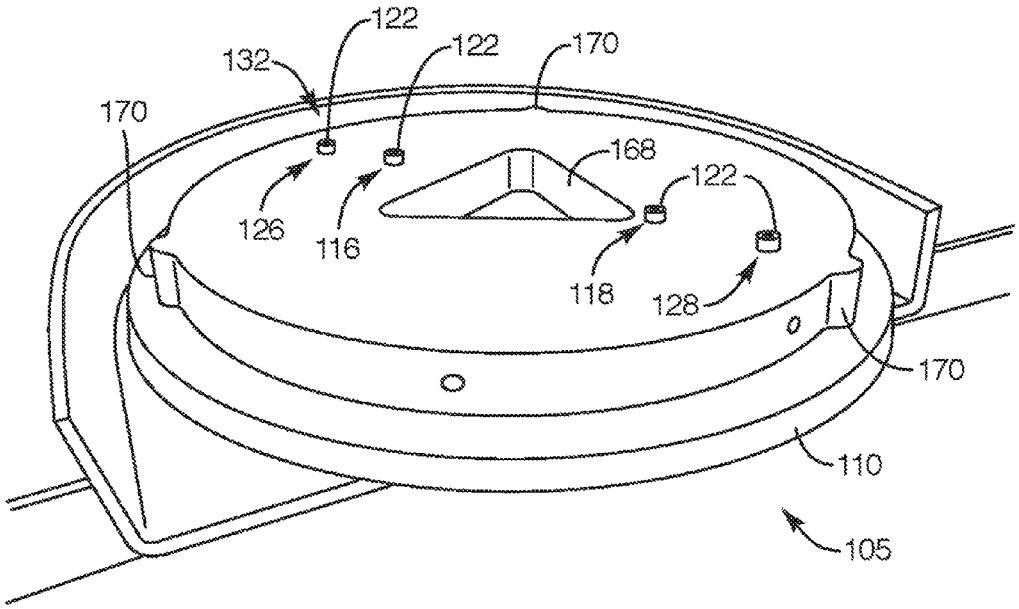
FIG. 4 is a perspective view of the pottery wheel of FIG. 3 after coupling of the carousel base of the shaping system of FIG. 1.

The result may be as shown in FIG. 4. As shown, the base 132 may be positioned on the rotatable wheel 110. If desired, the proximal ends 120 of the first bat pin 176 and the second bat pin 178 may be inserted into the first hole 164 and the second hole 166, respectively, of the base 132. This may leave the distal ends 122 of the first bat pin 176 and the second bat pin 178 exposed as shown in FIG. 4.

As also shown in FIG. 4, the base 132 may also include first and second supplemental holes (not visible), which may be radially aligned with the first hole 164 and the second hole 166 of the base 132, as shown. The proximal ends 120 of a first supplemental bat pin 126 and a second supplemental bat pin 128 may be inserted into the first and second supplemental holes, respectively, leaving the distal ends 122 of the first supplemental bat pin 126 and the second supplemental bat pin 128 exposed. The first and second supplemental holes may thus be used to couple a mold or bat with a different configuration or a larger size to the base 132. In the present example, only the first hole 164 and the second hole 166, and thence the first bat pin 116 and the second bat pin 118, will be used.

Returning to FIG. 2, the method 200 may then proceed to a step 225 in which a mold or bat is secured to the base 132. This may be done by positioning the mold or bat above the base 132, aligning coupling features of the mold or bat with the distal ends 122 of the bat pins to be used for coupling, and then moving the bat or mold into engagement with the base 132 such that the distal ends 122 are received in the corresponding holes. The resulting configuration is illustrated in FIGS. 5A and 5B, in relation to a mold and a bat, respectively.

Figure 5A:
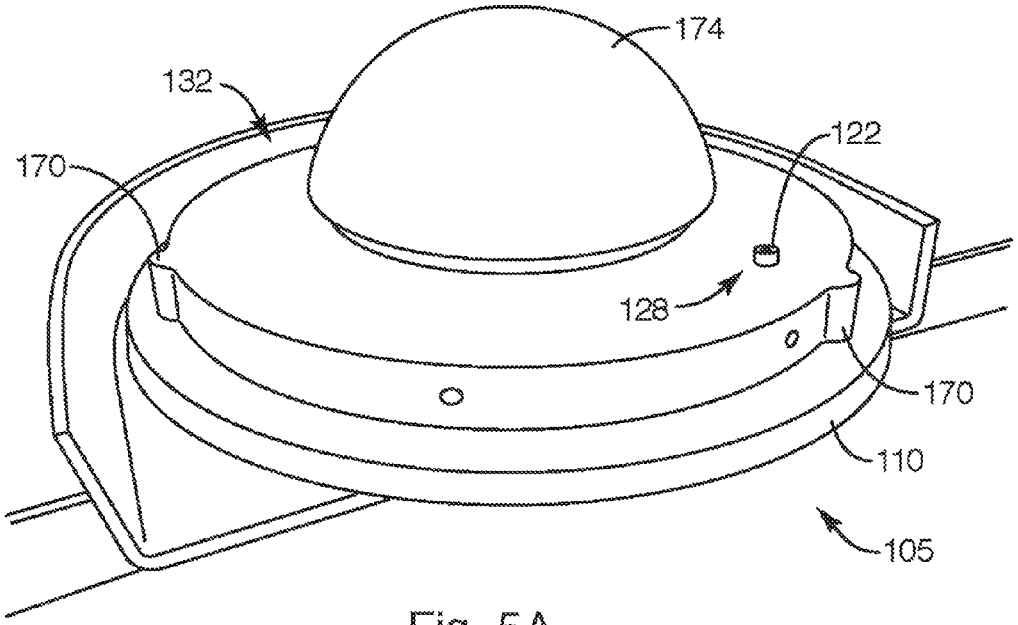
FIG. 5A is a perspective view of the pottery wheel of FIG. 3 after the coupling of a mold to the carousel base.

For example, with reference to FIG. 5A, this may entail aligning the distal ends 122 of the first bat pin 116 and the second bat pin 118 with the first hole 180 and the second hole 182 (not visible) of the mold 174 of FIG. 1. This may further entail aligning the central key 184 (not visible) of the mold 174 with the central aperture 168 of the base 132. Then, the mold 174 may be placed on the base 132 such that the distal ends 122 of the first bat pin 176 and the second bat pin 178 are received in the first hole 180 and the second hole 182, respectively, and the central key 184 is received in the central aperture 168. Optionally, the central key 184, alone, may be used to retain molds or bats that have a diameter smaller than the distance between the first bat pin 176 and the second bat pin 178.

As shown, the mold 174 may have a domed shape, which may be suitable for defining the interior surface of a piece of tableware such as a bowl. In alternative embodiments, a wide variety of molds of different shapes may be used, depending on the type of item to be created. Further, in other alternative embodiments, a bat may be used in place of a mold.

Figure 5B:
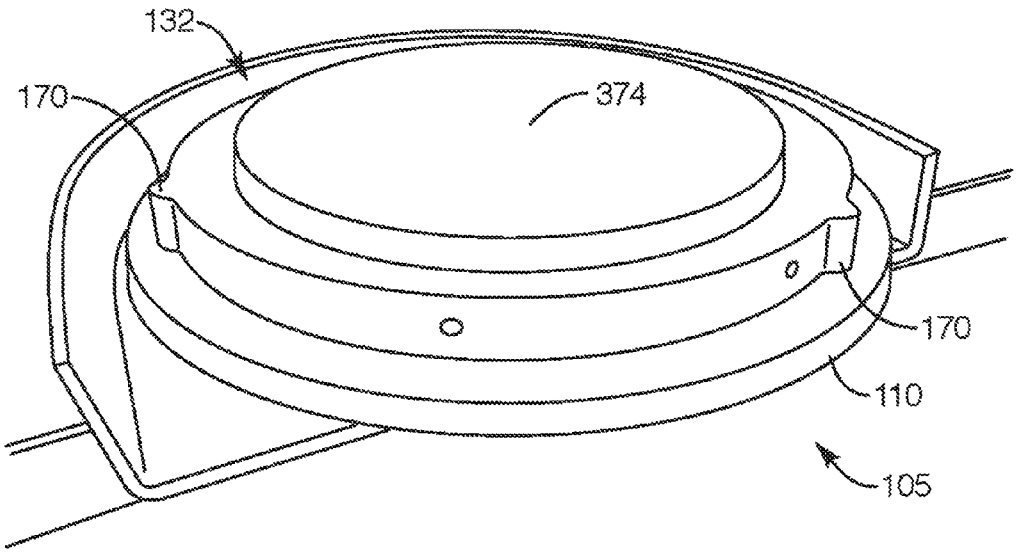
FIG. 5B is a perspective view of the pottery wheel of FIG. 3 after the coupling of a bat to the carousel base.

For example, with reference to FIG. 5B, a bat 374 may be coupled to the base 132 in place of the mold 174. The bat 374 may have a generally discoid shape suitable for workpieces that are to have a flat bottom or top surface. The bat 374 may be suitable for forming and preparing a workpiece with a discoid shape that can subsequently be used in any of a variety of contoured molds. The bat 374 may have coupling features (not shown) like those of the mold 174, such as the first hole 180, the second hole 182, and the central key 184 depicted in FIG. 1.

If desired, the bat 374 may also have additional coupling features in the form of additional holes (not shown) to receive the distal ends 122 of the first supplemental bat pin 126 and the second supplemental bat pin 128 shown in FIG. 4. Due to the larger size of the bat 374, it may be desirable to couple the bat 374 to the first supplemental bat pin 126 and the second supplemental bat pin 128 in addition to or in the alternative to the first bat pin 176, the second bat pin 178, and/or the central aperture 168.

Returning to FIG. 2, the method 200 may then proceed to a step 230 in which a workpiece is placed on the mold or bat. The workpiece may optionally be clay, and may optionally be prepared by flattening it into a discoid or other desired shape. If used in conjunction with a bat, this may entail simply placing the workpiece on the center of the bat. If used in conjunction with a mold, the workpiece may be wrapped over the shape of the mold such that the interior surface of the workpiece adopts the shape of the exterior surface of the mold. The resulting configuration is shown in FIG. 6.

Figure 6:
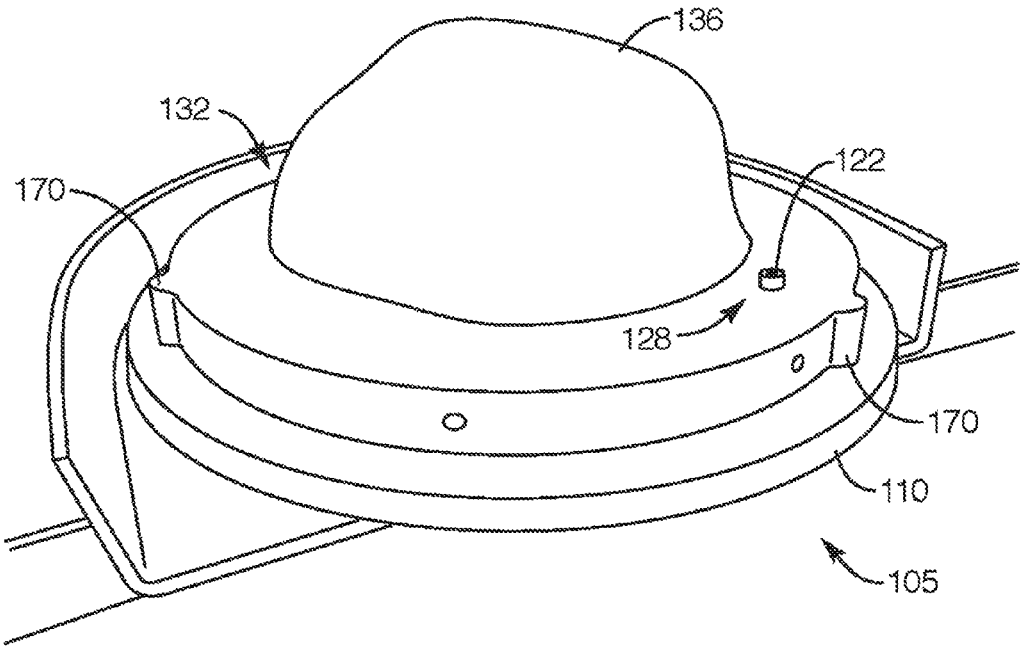
FIG. 6 is a perspective view of the pottery wheel of FIG. 3 after placement of a workpiece on the mold of FIG. 5A.

Referring to FIG. 6, a workpiece 136 has been placed on the mold 174. The workpiece 136 may substantially cover the mold 174 so that the mold 174 is generally not visible. If desired, the interior surface of the workpiece 136 may be wetted to enhance its adhesion to the mold 174. The workpiece 136 may also be pressed against the exterior surface of the mold 174 to enhance adhesion and/or help the interior surface of the workpiece 136 to obtain a more even contour. The exterior surface of the workpiece 136 may then have a shape that loosely follows that of the exterior surface of the mold 174, but with significant irregularities that can be remedied through the aid of the system 100.

Returning to FIG. 2 the method 200 may then proceed to a step 235 in which the workpiece 136 is prepared for shaping. This may entail wetting the workpiece 136, removing any protruding portions of the workpiece 136 that may interfere with the shaping process, or the like. If desired, the workpiece 136 may be wetted multiple times throughout the shaping process to help it adhere to the mold 174 and/or the base 132 and/or help avoid binding of the template 150 against the workpiece.

The method 200 may then proceed to a step 240 in which the fixture 134 is secured to the base 132. This may entail positioning the fixture 134 above the base 132, aligning the alignment sockets 194 of the support ring 186 of the fixture 134 with the alignment key 170 of the base 132, and then lowering the fixture 134 onto the rotatable wheel 110 such that the support ring 186 encircles the base 132 and the alignment keys 170 of the base 132 are received in the alignment sockets 194 of the support ring 186. The resulting configuration is shown in FIG. 7.

Figure 7:
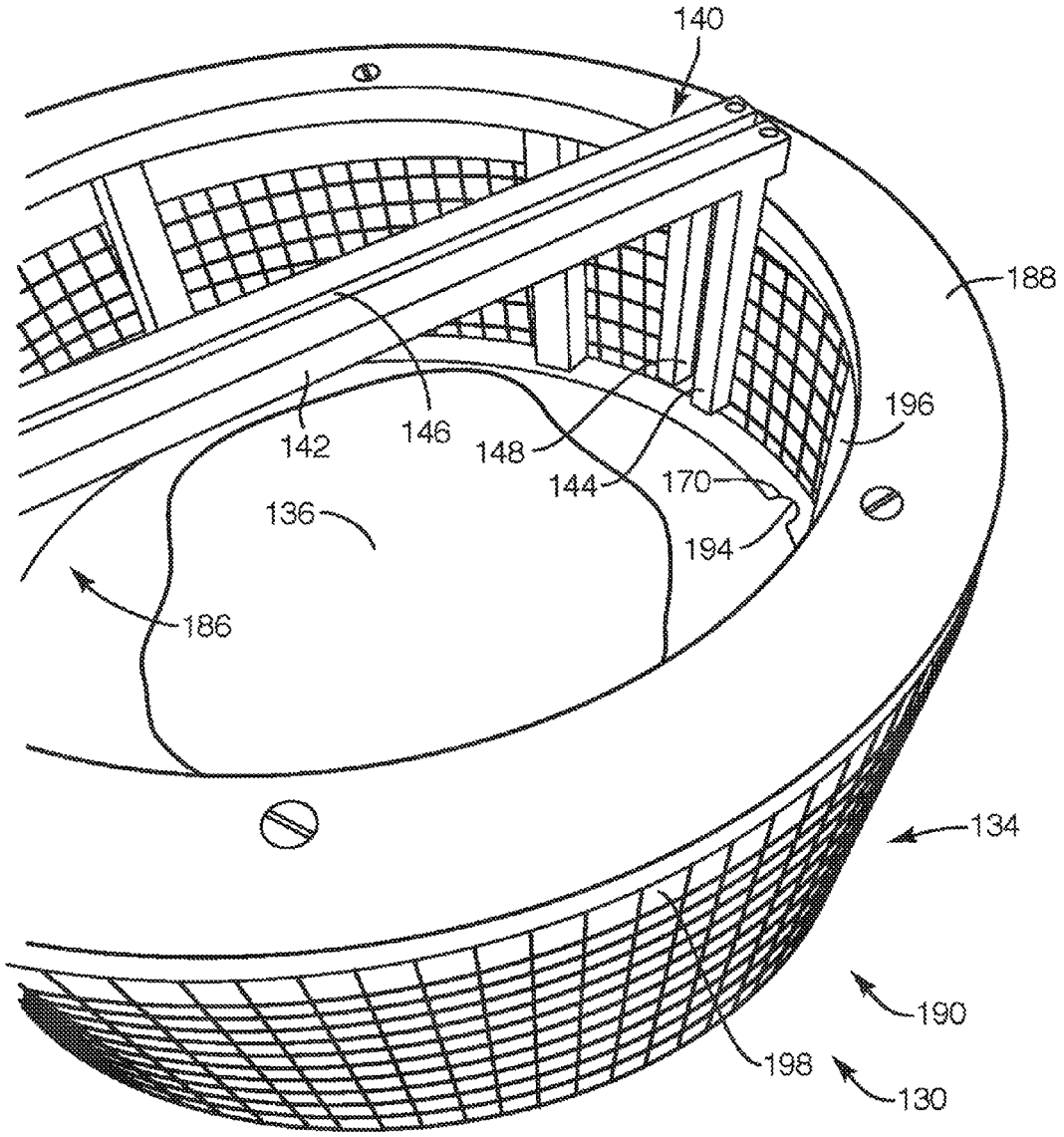
FIG. 7 is a perspective view of the pottery wheel of FIG. 3 after coupling of the carousel fixture and coupled template holder to the carousel base.

As shown in FIG. 7, the workpiece 136 may be generally contained within the carousel defined by the support assembly 130 when this step is complete. The radial brace 142 may generally extend over the top of the workpiece 136. Due to the receipt of the alignment keys 170 within the alignment sockets 194, the fixture 134 may rotate with the base 132 and the rotatable wheel 110. However, the rotary coupling 188 may allow the template holder 140 to remain stationary while this occurs.

Returning to FIG. 2, the method 200 may then proceed to a step 245 in which the template 150 is retained with the template interface of the template holder 140. As indicated previously, this may entail inserting the plate 152 of the template 150 through the radial brace slot 146 of the radial brace 142 until the adjustable depth stop 154 rests on the top surface of the radial brace 142. This may further entail inserting the registration edge 158 of the plate 152 into the axial brace slot 148 of the axial brace 144. The resulting configuration is shown in FIG. 8.

Figure 8:
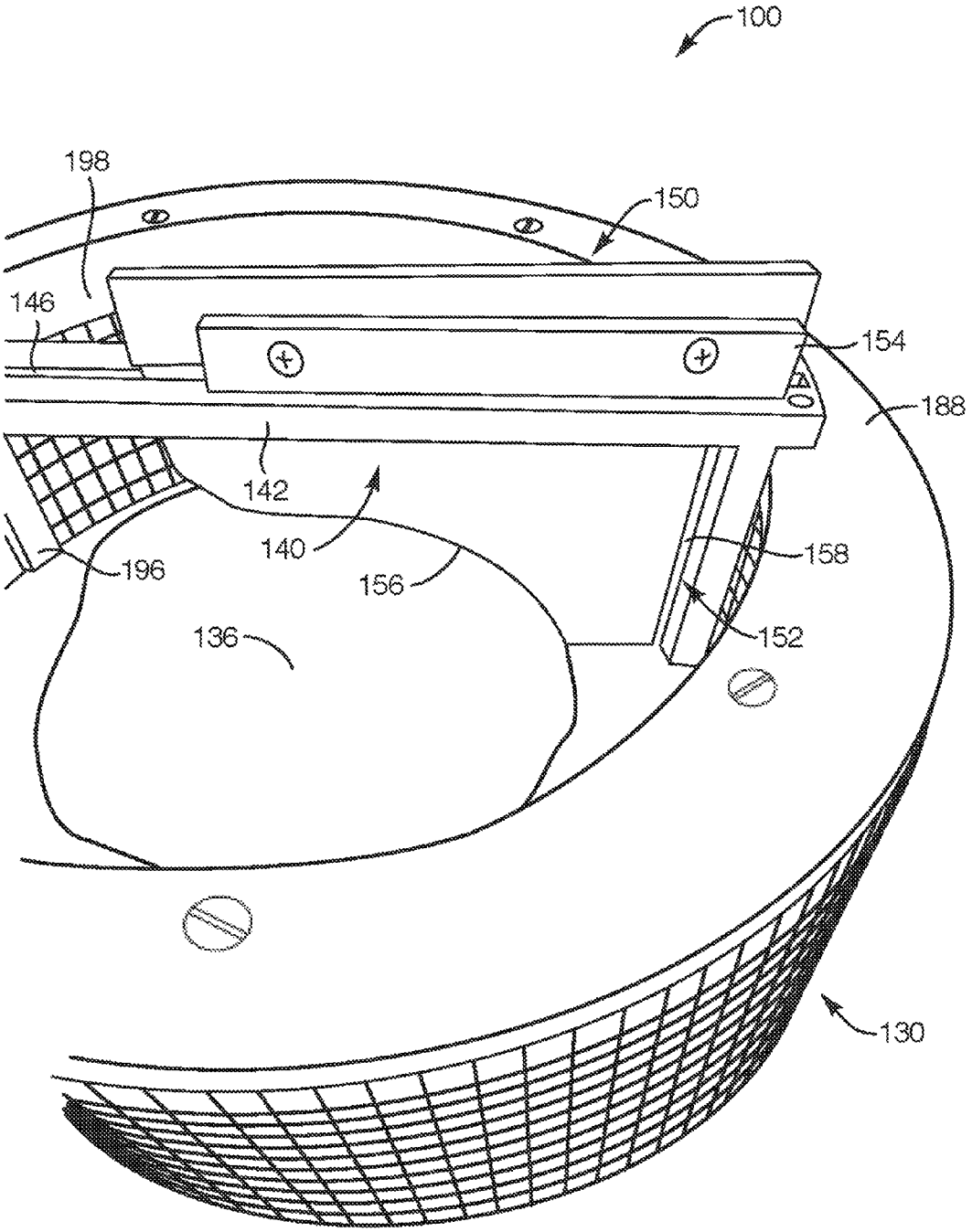
FIG. 8 is a perspective view of the pottery wheel of FIG. 3 after retention of a jiggering template in the template interface of the template holder of FIG. 7.

As shown in FIG. 8, the template 150 has been retained by the template holder 140 in the manner indicated above. The plate 152 now passes through the radial brace slot 146 of the radial brace 142 so that the contouring edge 156 is proximate the exterior surface of the workpiece 136. The adjustable depth stop 154 may rest on the top surface of the radial brace 142. The registration edge 158 may be retained in the axial brace slot 148 of the axial brace 144 to help the plate 152 remain in its proper vertical orientation.

Returning to FIG. 2, the method 200 may then proceed to a step 250 in which the rotatable wheel 110 of the pottery wheel 105 is rotated. Rotation of the rotatable wheel 110 may cause rotation of the support assembly 130 and the workpiece 136. However, the template holder 140 may be kept stationary, for example, by grasping the adjustable depth stop 154 of the template 150 while the support assembly 130 rotates to keep the template holder 140 from rotating with the support assembly 130. This can be done by hand, or with a tool such as a gripper held in the hand, an anchor secured to a stationary object, or the like.

The method 200 may then proceed to a step 255 in which the workpiece 136 is contacted with the template 150 to define the desired contour in the workpiece 136. This may entail moving the contouring edge 156 into contact with the workpiece 136. This may advantageously be done while the workpiece 136 is rotating to help avoid binding the workpiece 136 on the contouring edge 156 as the workpiece 136 begins to rotate. Thus, in some embodiments, the step 250 may be performed prior to the step 245 so that the workpiece 136 is already rotating when the template 150 is positioned and retained. In other embodiments, positioning and/or retention of the template 150 may occur before the workpiece 136 begins to rotate, but the template 150 may be moved (i.e., from a first retained position to a second retained position) to move the contouring edge 156 into engagement with the workpiece 136.

Notably, it may take several passes to define the desired contour in the workpiece 136. It may be desirable to limit the amount of material removed by the template 150 in a single pass (i.e., a single rotation of the workpiece 136) to help avoid causing the workpiece 136 to bind on the contouring edge 156. Such binding may cause the workpiece 136 to dislodge from the mold 174 and stop rotating with the mold 174. It may be desirable to stop the process one or more times as material is removed in order to remove excess material from the template 150, further wet the workpiece 136, and the like. Material may be removed until the desired contour has been formed in the workpiece 136.

The method 200 may then proceed to a step 260 in which excess material (for example, excess clay) is removed from the shaped workpiece. Such material may, for example, tend to gather around the junction between the workpiece 136 and the base 132, underneath the bottom edge of the template 150. Tools and/or methods known in the art may be used to accomplish this.

The method 200 may then proceed to a step 265 in which the workpiece 136 is removed. Optionally, the mold or bat may also be removed (for example, the mold 174 or the bat 374), along with other components such as the fixture 134. Removal of the fixture 134 may make it easier to access the workpiece 136. The workpiece 136 may now have the desired shape. The method 200 may then end 290. Optionally, further steps may be undertaken relative to the workpiece 136 in preparation for firing. Then, the workpiece 136 may be fired to harden it in the desired shape.

The method 200 is only one of many methods that may be employed within the scope of the present disclosure. Those of skill in the art will recognize that the various steps of the method 200 may be reordered in a wide variety of ways. Further, steps of the method 200 may be omitted and/or supplemented with other steps within the scope of the present disclosure.

Depth Stop Adjustment

As mentioned previously, the position of the adjustable depth stop 154 relative to the plate 152 may be adjusted to alter the depth at which the plate 152 is retained by the template holder 140. The manner in which this is accomplished will be shown and described in connection with FIGS. 9A and 9B.

Figure 9A:
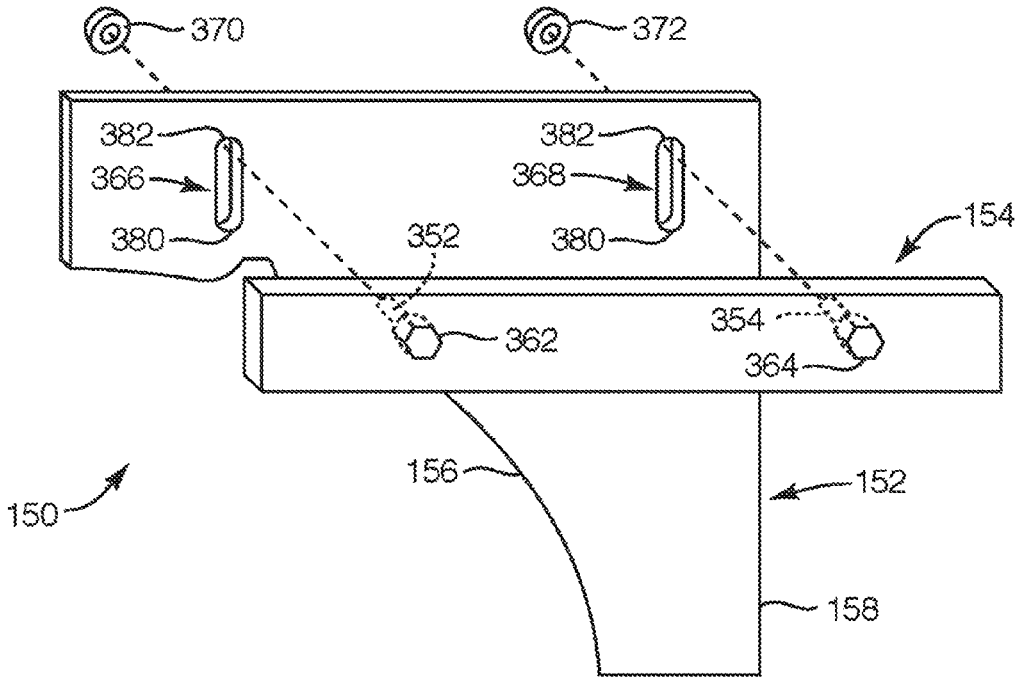
FIG. 9A is an exploded, perspective view of the jiggering template of FIG. 8, with a depth stop positioned to be coupled to a plate in a first position.

Referring to FIG. 9A, an exploded, perspective view illustrates the template 150 with the adjustable depth stop 154 positioned for attachment to the 152 at a first position. The first position may provide for positioning of the plate 152 at a maximum depth relative to the rotatable wheel 110 (i.e., at a minimum distance between the plate 152 and the rotatable wheel 110).

As shown, the template 150 may include a first fastener 352 and a second fastener 354, which may be received within a first hole 362 and a second hole 364, respectively, of the adjustable depth stop 154. The first fastener 352 and the second fastener 354 may optionally be screws, bolts, or the like. The first hole 362 and the second hole 364 may optionally be countersunk so that the heads of the first fastener 352 and the second fastener 354 can fit within the first hole 362 and the second hole 364, respectively. The shank of each of the first fastener 352 and the second fastener 354 may protrude from the first hole 362 and the second hole 364 toward the plate 152.

The shank of the first fastener 352 may be inserted through a first slot 366 formed in the plate 152, and received by a first receiver 370. Similarly, the shank of the second fastener 354 may be inserted through a second slot 368 formed in the plate 152, and received by a second receiver 372. In some embodiments, the shanks of the first fastener 352 and the second fastener 354 may be threaded; the first receiver 370 and the second receiver 372 may thus have interior threads that receive those of the shanks of the first fastener 352 and the second fastener 354. The first receiver 370 and the second receiver 372 may be tightened on the first fastener 352 and the second fastener 354, respectively, to grip the plate 152 between the adjustable depth stop 154 and the first receiver 370 and the second receiver 372, thereby keeping the plate 152 securely positioned relative to the adjustable depth stop 154.

As shown, the first slot 366 and the second slot 368 may each have a proximal end 380 and a distal end 382. The adjustable depth stop 154 is positioned, in FIG. 9A, such that the shanks of the first fastener 352 and the second fastener 354 will reside at the distal ends 382 of the first slot 366 and the second slot 368. This will position the plate 152 at its maximum depth, i.e., its closest position relative to the rotatable wheel 110. Positioning the shanks of the first fastener 352 and the second fastener 354 further toward the proximal ends 380 of the first slot 366 and the second slot 368 will cause the plate 152 to reside further from the rotatable wheel 110.

Figure 9B:
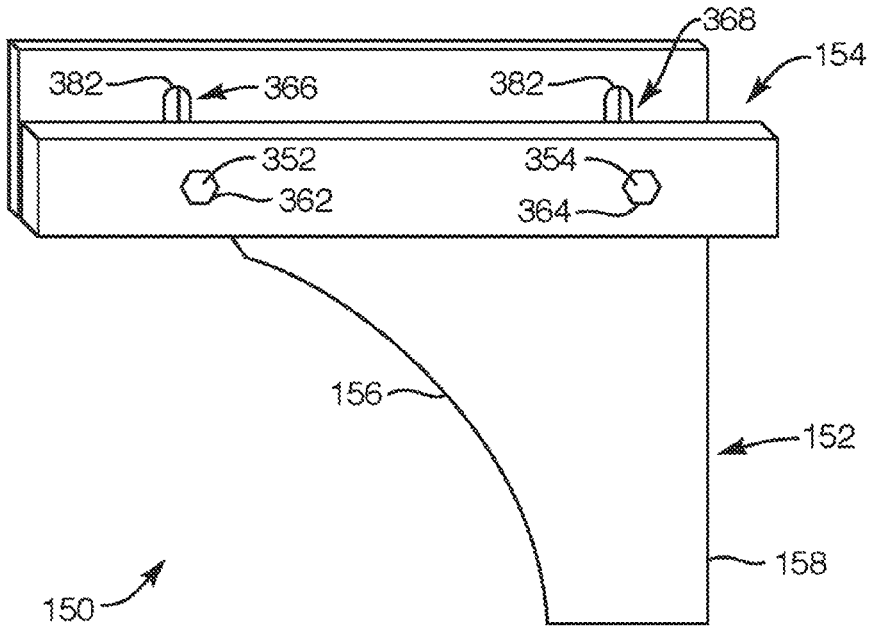
FIG. 9B is a perspective view of a jiggering template of FIG. 8, with the depth stop coupled to the plate in a second position.

Referring to FIG. 9B, a perspective view illustrates the template 150 with the adjustable depth stop 154 repositioned relative to the plate 152 to position the plate 152 at a minimum depth relative to the rotatable wheel 110 (i.e., at a maximum distance between the plate 152 and the rotatable wheel 110). The shanks (not shown) of the first fastener 352 and the second fastener 354 may pass through the first slot 366 and the second slot 368, respectively, proximate the proximal ends 380 (not shown) of the first slot 366 and the second slot 368. The template 150 may be adjusted to this configuration from that of FIG. 9A, for example, by loosening the first receiver 370 and the second receiver 372 and sliding the shanks of the first fastener 352 and the second fastener 354 from the distal ends 382 to the proximal ends 380 of the first slot 366 and the second slot 368. The first receiver 370 and the second receiver 372 may then be tightened to cause the template 150 to remain in the configuration shown in FIG. 9B.

It may be advantageous to commence shaping (for example, in the step 255 of FIG. 2) with the plate 152 positioned relatively further from the rotatable wheel 110, for example, as shown in FIG. 9B, and remove some material from the workpiece 136. Then, the template 150 may be adjusted for successive passes to move the plate 152 closer to the rotatable wheel 110 (i.e., toward the configuration of FIG. 9A). One or more adjustment steps may be made. In this manner, the amount of material removed from the workpiece 136 may be kept at a relatively consistent level to help avoid binding of the workpiece 136 on the plate 152 and provide for a smooth contour on the workpiece 136.

In alternative embodiments (not shown), a template may not have a depth stop. Rather, the depth of the plate may instead be manually set by the potter. The potter may simply grasp the plate at its top end, which may protrude above the radial brace slot 146 of the radial brace 142, and control, by hand, the depth of the plate relative to the rotatable wheel 110.

In one embodiment, the template 150 of FIG. 9A may be used in this manner, for example, by configuring the adjustable depth stop 154 as in FIG. 9A, and then using the plate 152 as a handle to selectively hold the adjustable depth stop 154 above the top surface of the radial brace 142. In this manner, the potter may exert manual control over the depth at which the plate 152 resides. The potter may simply urge the adjustable depth stop 154 gradually toward the top surface of the radial brace 142 as material is removed from the workpiece 136.

In order to facilitate such usage of the template 150, the template 150 may be retained by the template holder 140 in a manner that restricts and/or prevents relative motion between the template 150 and the rotatable wheel 110 in the radial direction (i.e., perpendicular to the axis 124, as defined above), but not in the axial direction (i.e., parallel to the axis 124). Further, the template 150 may be retained in the template holder 140 such that the template 150 is rotatable, relative to the rotatable wheel 110, about the axis 124, thus enabling the template 150 to remain stationary while the rotatable wheel 110 rotates.

Jollying Template

Figure 10:
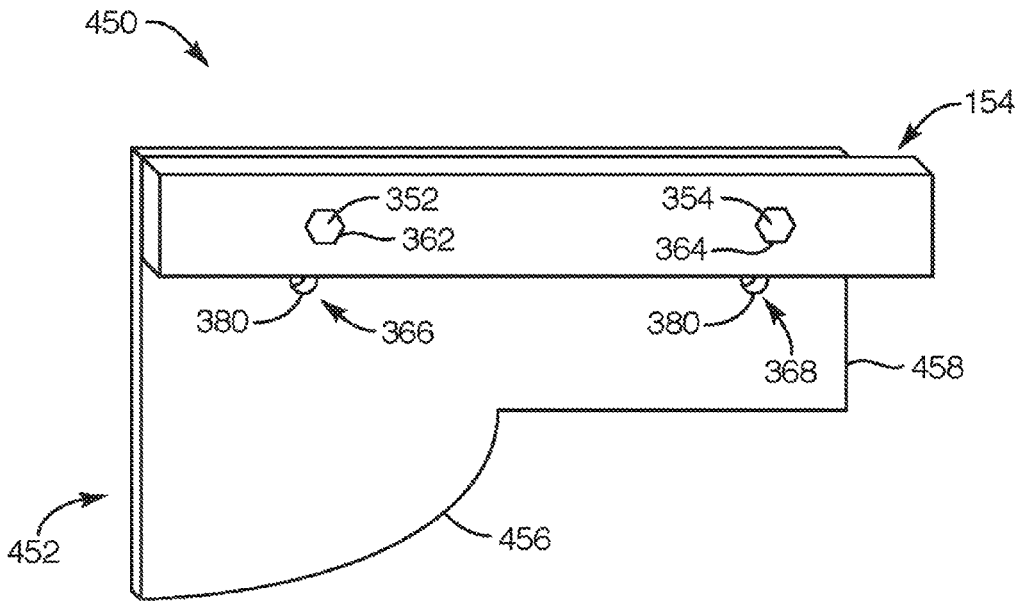
FIG. 10 is a perspective view of a jollying template according to one embodiment.

Referring to FIG. 10, a perspective view illustrates a template 450 according to an alternative embodiment of the invention. While the template 150 of FIGS. 9A and 9B may be a jiggering template (i.e., a template that contours the exterior surface of a workpiece), the template 450 of FIG. 10 may be a jollying template (i.e., a template that contours the interior surface of a workpiece). Thus, the template 450 may have a plate 452 with a different configuration from the plate 152 of the template 150. The template 450 may also have an adjustable depth stop 154, which may be similar to that of the template 150.

The plate 452 may have a contouring edge 456 and a registration edge 458. The edge 456 may have a shape and orientation suitable for defining the interior contour of an article such as a bowl. Thus, the contouring edge 456 may be oriented outboard (i.e., toward the registration edge 458) rather than inboard, as in the template 150.

The template 450 may be used in connection with the template holder 140 of FIG. 1, in a manner similar to that of the template 150. The template 450 may be retained by the template interface of the template holder 140 by inserting the plate 452 through the radial brace slot 146 of the radial brace 142, and positioning the registration edge 458 of the plate 452 in the axial brace slot 148 of the axial brace 144. As in the case of the template 150, the position of the adjustable depth stop 154 relative to the plate 452 may be adjusted to control the depth at which the plate 452 resides relative to the rotatable wheel 110. As in the case of the template 150, manual depth control may be used in addition to or in the alternative to the use of the adjustable depth stop 154 to control the depth of the plate 452 relative to the rotatable wheel 110.

Alternative Embodiments

FIG. 1 represents only one of many embodiments of shaping systems within the scope of the present disclosure. It would not be possible to provide an exhaustive description of such alternative embodiments, but two examples will be shown and described in connection with FIGS. 11 and 12, as follows.

Figure 11:
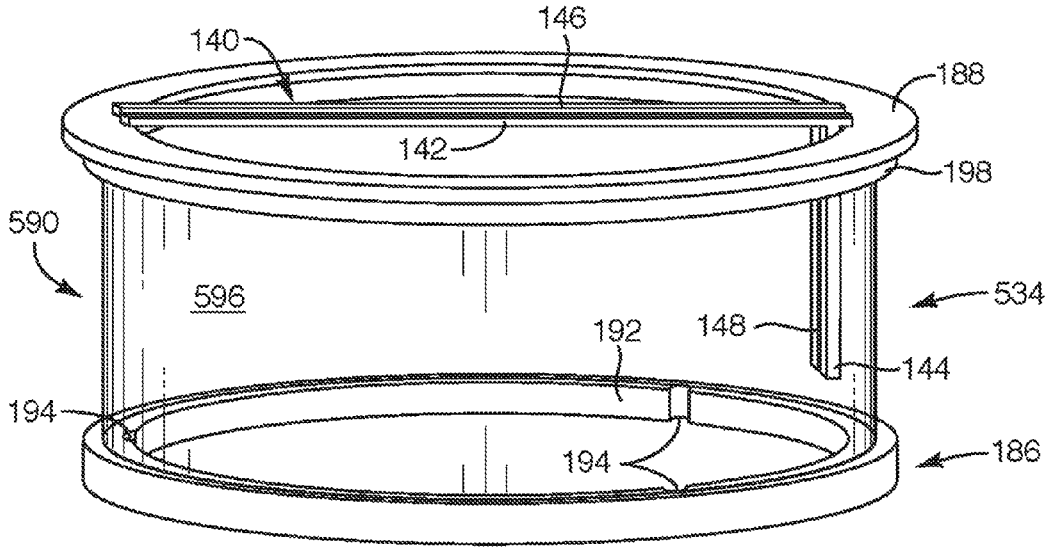
FIG. 11 is a perspective view of a shaping system according to one alternative embodiment.

Referring to FIG. 11, a perspective view illustrates a fixture 534 that may be incorporated in a shaping system according to one alternative embodiment of the invention. The fixture 534 may be used in conjunction with a base 132 to provide a support assembly, which may be used to support a template holder like the template holder 140 of FIG. 1.

The fixture 534 may have a support ring 186 and a distal ring 198, both of which may be similar to their counterparts of the fixture 134 of FIG. 1. The distal ring 198 may be supported above the support ring 186 by a support structure 590, which may be different from the support structure 190 of FIG. 1. Specifically, the support structure 590 may not have support columns, but may instead have a translucent screen 596 that spans the space between the support ring 186 and the distal ring 198. The translucent screen 596 may be formed of glass and/or a translucent polymer such as polyethylene, polypropylene, polycarbonate, and/or acrylic. The material used to form the translucent screen 596 may be selected for structural strength as well as translucency. The translucent screen 596 may provide the advantage of easier visibility of the workpiece 136 as the shaping process occurs.

Figure 12:
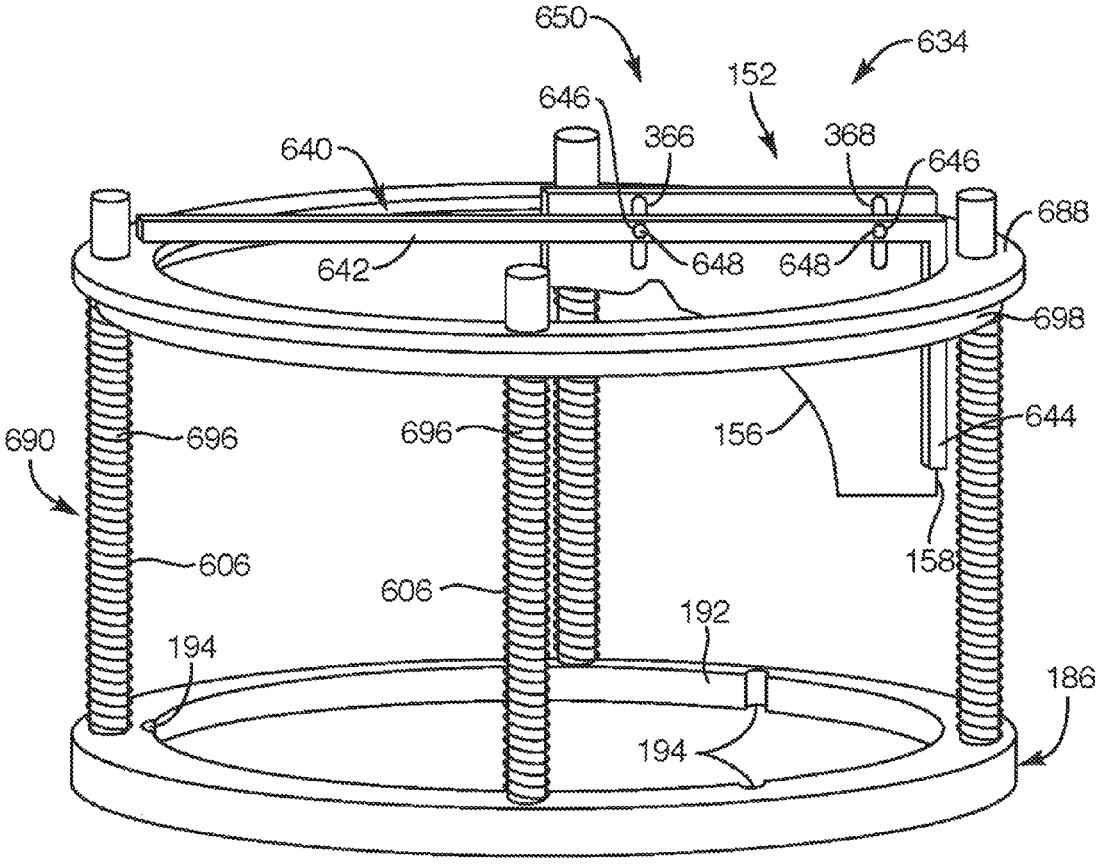
FIG. 12 is a perspective view of a shaping system according to another alternative embodiment.

Referring to FIG. 12, a perspective view illustrates a fixture 634, template holder 640, and template 650 according to another alternative embodiment. The fixture 634 may be used in conjunction with a base 132 to provide a support assembly, which may be used to support the template holder 640. The template holder 640 may, in turn, retain the template 650. The fixture 634, template holder 640, and template 650 may be designed to facilitate manual control of the depth of contouring by the potter, as will be described below.

The fixture 634 may have a support ring 186 like that of the fixture 134 of FIG. 1, and a distal ring 698 supported above the support ring 186 by a support structure 690. A rotary coupling 688 may be supported by the distal ring 698, which may be similar in function to the rotary coupling 188 and the distal ring 198 of FIG. 1. The support structure 690 may support the distal ring 698 over the support ring 186 via columns 696. However, the columns 696 may not be rigidly secured to the distal ring 698, but may instead be slidably coupled to the distal ring 698 such that the distal ring 698 may move up or down along the columns 696. Thus, the height of the support structure 690 may be variable.

Further, a coil spring 606 may be wrapped around each of the columns 696. The coil springs 606 may support the weight of the distal ring 698, the rotary coupling 688, the template holder 640, and the template 650 by urging the distal ring 698 away from the support ring 186. The coil springs 606 may have sufficient travel to permit significant upward and downward motion of the template 650 relative to the support ring 186.

The template 650 may be configured differently from the template 150, in that the template 650 may exclude the adjustable depth stop 154. Thus, the template 650 may include only the plate 152 of the template 150, with no adjustable depth stop. Rather, the plate 152 of the template 650 may be attached directly to the template holder 640.

More specifically, the template holder 640 may have a radial brace 642 and an axial brace 644. The radial brace 642 may extend radially relative to the rotatable wheel 110, and the axial brace 644 may extend axially, i.e., parallel to the axis 124 of the rotatable wheel 110. The radial brace 642 may have holes 646 that receive fasteners 648, which may be like the first fastener 352 and the second fastener 354 of the template 150, as shown in FIGS. 9A and 9B. The fasteners 648 may pass through the first slot 366 and the second slot 368 of the plate 152. Receivers (not shown), which may be like the first receiver 370 and the second receiver 372 of FIG. 9A, may be secured to the shanks of the fasteners 648 to secure the plate 152 to the radial brace 642. Thus, the plate 152 may be firmly attached to the radial brace 642 until the fasteners 648 are loosened. The registration edge 158 of the plate 152 may rest against the axial brace 644, which may support the registration edge 158 as the contouring edge 156 removes material from the workpiece 136.

In operation, the potter may secure the plate 152 to the radial brace 642 as indicated above. He or she may grip the plate 152 and/or the radial brace 642 by hand as the fixture 634 and the workpiece 136 rotate to keep the plate 152 and the radial brace 642 in a relatively constant orientation. He or she may then, by hand, urge the plate 152 downward into contact with the workpiece 136, thereby compressing the coil springs 606. As material is removed from the workpiece 136 by the plate 152, the potter may exert additional downward force on the plate 152 to lower the plate 152, thereby continuing the contouring process until the workpiece 136 has been contoured in the desired manner. Then, the potter may release the plate 152, permitting coil springs 606 to elongate again such that the plate 152 and the template holder 640 to return to their natural positions.

Figure 13:
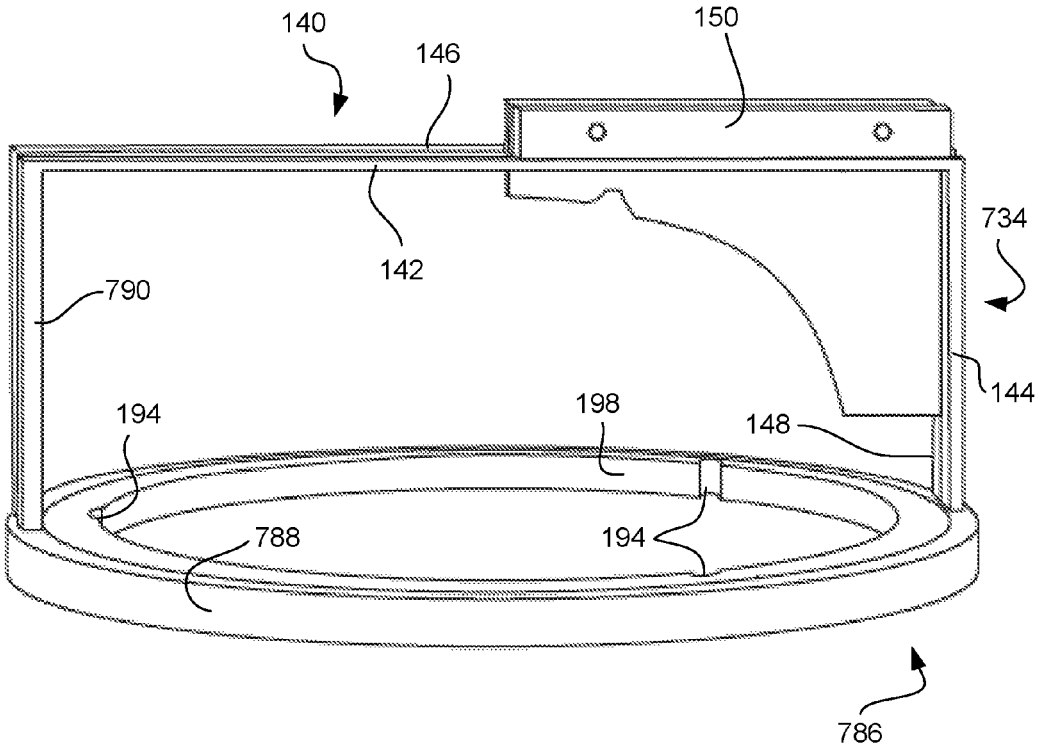
FIG. 13 is a perspective view of a shaping system according to another alternative embodiment.

Referring to FIG. 13, a perspective view illustrates a fixture 734 that may be incorporated in a shaping system according to yet another alternative embodiment of the invention. The fixture 734 may be used in conjunction with a base 132 to provide a support assembly, which may be used to support a template holder like the template holder 140 of FIG. 1.

The fixture 734 may have a support ring 786. By contrast with previous embodiments, the fixture 734 may lack a distal ring like the distal ring 198 of the fixture 134 of FIG. 1. Rather, the support ring 786 may have an integrated rotary coupling 788, which may take the form of a ring bearing. The ring bearing may be enclosed as in previous embodiments to avoid exposure of the bearing surfaces to clay, dust, or other matter. Thus, the outer portion of the support ring 786 may be rotatable relative to the inner section of the support ring 786, and may be capable of remaining stationary while the inner section rotates with the rotatable wheel 110.

The template holder 140 may be secured directly to the outer section of the support ring 786. More specifically, the axial brace 144 may be secured to the outer section. The fixture 734 may also have a support structure 790 that directly supports the end of the radial brace opposite to the axial brace 144. The template holder 140 may retain a template, such as the template 150 of FIGS. 9A and 9B, in a manner similar to that of previous embodiments.

Advantageously, the fixture 734 may facilitate the ability of the user to grasp and/or guide the template 150. Further, the fixture 734 may permit greater access to the workpiece 136 so that other processes may be carried out without removing the fixture 734 from the rotatable wheel 110. For example, clay may be added to the workpiece 136 or removed from the workpiece 136, ridges or other shapes not defined by the template 150 may be formed in the workpiece 136, and/or other actions may be carried out relative to the workpiece 136 without removing the fixture 734.

Figure 14:
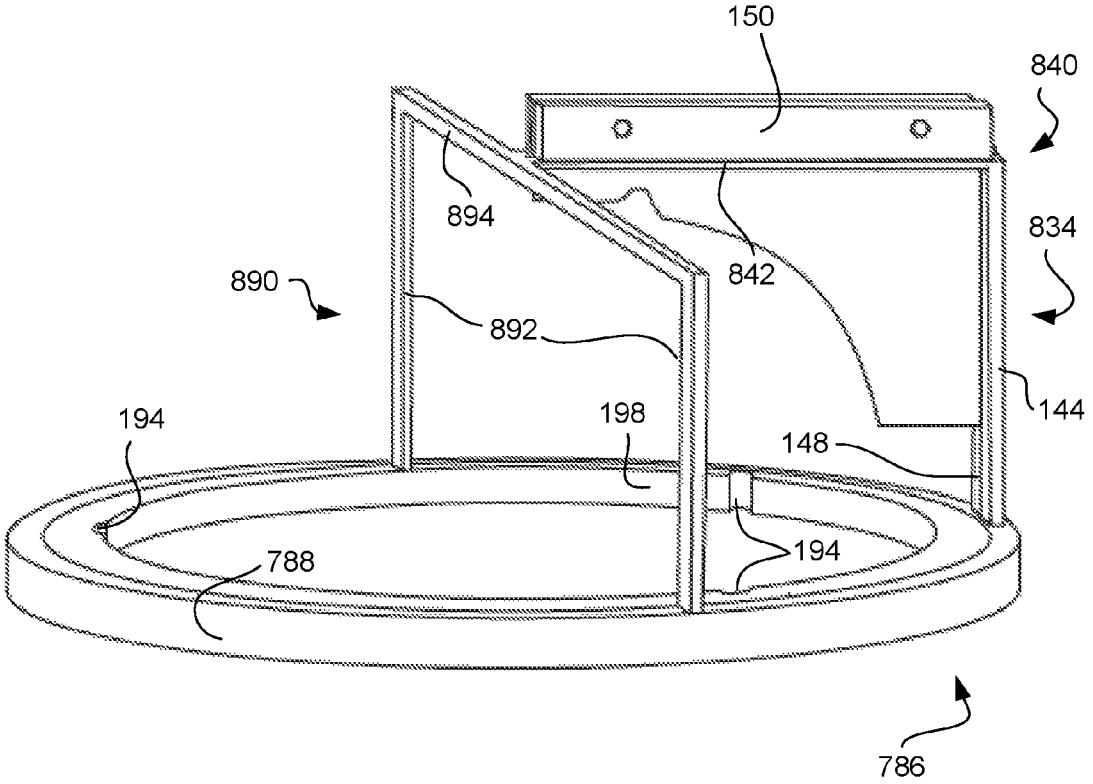
FIG. 14 is a perspective view of a shaping system according to another alternative embodiment.

Referring to FIG. 14, a perspective view illustrates a fixture 834 that may be incorporated in a shaping system according to still another alternative embodiment of the invention. The fixture 834 may be used in conjunction with a base 132 to provide a support assembly, which may be used to support a template holder 840 similar to the template holder 140 of FIG. 1.

The fixture 834 may have a support ring 786 like that of the previous embodiment. Hence, the support ring 786 of FIG. 14 may also have an integrated rotary coupling 788, which may take the form of a ring bearing. Thus, the outer portion of the support ring 786 may be rotatable relative to the inner section of the support ring 786, and may be capable of remaining stationary while the inner section rotates with the rotatable wheel 110.

The template holder 840 may be secured directly to the outer section of the support ring 786. More specifically, as in the previous embodiment, the axial brace 144 may be secured to the outer section. The axial brace 144 of the template holder 840 may be similar in configuration to that of the template holder 140 of previous embodiments. However, the radial brace 842 of the template holder 840 may not extend across the entire diameter of the fixture 834. Rather, the radial brace 842 may only extend across half of the diameter of the fixture. A template 150 such as that of FIGS. 9A and 9B may be retained by the radial brace 842 in combination with the axial brace 144.

The fixture 834 may also have a support structure 890 that supports the end of the radial brace 842 that is proximate the axis of the fixture 834. The support structure 890 may have a pair of struts 892 that extend generally parallel to the axial brace 144, and a crossbeam 894 that secures the free ends (i.e., the top ends in a normal orientation) of the struts 892 together. The center of the crossbeam 894 may be secured to and/or integrally formed with the end of the radial brace 842 that is proximate the axis of the fixture 843.

The fixture 834 may provide benefits similar to those provided by the fixture 734 of FIG. 13. Additionally, usage of the support structure 890 may provide additional structural rigidity to the template holder 840, providing greater accuracy in the use of the template 150. Further, the support structure 890 may provide easier access to the side of the workpiece 136 opposite from that being shaped by the template 150. Additionally or alternatively, the support structure 890 may provide more flexibility for the user, because the user may grasp either strut 892 and/or the crossbeam 894 to keep the template holder 840 from rotating.

The above description and referenced drawings set forth particular details with respect to possible embodiments. Those of skill in the art will appreciate that the techniques described herein may be practiced in other embodiments. First, the particular naming of the components or capitalization of terms is not mandatory or significant, and the mechanisms that implement the techniques described herein may have different names, formats, or protocols. Also, the particular division of functionality between the various system components described herein is merely exemplary, and not mandatory; functions performed by a single system component may instead be performed by multiple components, and functions performed by multiple components may instead be performed by a single component.

Reference in the specification to "one embodiment" or to "an embodiment" means that a particular feature, structure, or characteristic described in connection with the embodiments is included in at least one embodiment. The appearances of the phrase "in one embodiment" in various places in the specification are not necessarily all referring to the same embodiment.

While a limited number of embodiments has been described herein, those skilled in the art, having benefit of the above description, will appreciate that other embodiments may be devised which do not depart from the scope of the claims. In addition, it should be noted that the language used in the specification has been principally selected for readability and instructional purposes, and may not have been selected to delineate or circumscribe the inventive subject matter. Accordingly, the disclosure is intended to be illustrative, but not limiting.

What is claimed is:

1. A system for facilitating shaping of a workpiece on a pottery wheel comprising a rotatable wheel, the rotatable wheel comprising a rotatable wheel coupling feature, the system comprising:

a support assembly comprising a carousel, the carousel comprising:

a carousel base comprising a support assembly coupling feature capable of being coupled to the rotatable wheel coupling feature such that rotation of the rotatable wheel causes rotation of the support assembly; and a carousel fixture comprising a rotary coupling; and a template holder coupled to the rotary coupling such that the template holder is rotatable relative to the support assembly, the template holder comprising a template interface shaped to retain a template to constrain motion of the template relative to the rotatable wheel.

2. The system of claim 1, further comprising a jiggering template comprising a jiggering edge shaped such that, in response to contact with the workpiece during rotation of the workpiece, the jiggering edge defines an exterior contour on the workpiece.

3. The system of claim 1, further comprising a jollying template comprising a jollying edge shaped such that, in response to contact with the workpiece during rotation of the workpiece, the jollying edge defines an interior contour on the workpiece.

4. The system of claim 1, further comprising a template comprising an adjustable depth stop that is adjustable to permit retention of the template by the template holder in any of a plurality of displacements from the rotatable wheel, wherein in each of the plurality of displacements, the template holder retains the template such that the template is not movable along a radial direction relative to the rotatable wheel.

5. The system of claim 4, wherein the template comprises a plate comprising a shaping edge shaped such that, in response to contact with the workpiece during rotation of the workpiece, the shaping edge defines a contour on the workpiece;

wherein the template interface comprises a radial brace extending generally radially relative to the rotatable wheel;

and wherein the radial brace comprises a radial brace slot sized to receive the plate in any of the plurality of displacements.

6. The system of claim 5, wherein the plate further comprises a registration edge positioned to extend axially relative to the rotatable wheel when the template is retained by the template interface;

wherein the template interface further comprises an axial brace extending generally parallel to an axis of the rotatable wheel;

and wherein the axial brace comprises an axial brace slot sized to receive the registration edge.

7. A system for facilitating shaping of a workpiece on a pottery wheel comprising a rotatable wheel, the rotatable wheel comprising a rotatable wheel coupling feature, the system comprising:

a support assembly comprising a carousel, the carousel comprising:

a carousel base comprising a support assembly coupling feature capable of being coupled to the rotatable wheel coupling feature such that rotation of the rotatable wheel causes rotation of the support assembly, wherein the carousel base comprises a discoid shape that rests on the rotatable wheel in response to coupling of the support assembly coupling feature to the rotatable wheel coupling feature; and a carousel fixture comprising:

a rotary coupling comprising a ring bearing;

a support ring capable of being coupled to the carousel base; and a support structure that extends from the support ring to the rotary coupling to maintain the rotary coupling in an elevated position relative to the rotatable wheel in response to coupling of the support assembly coupling feature to the rotatable wheel coupling feature and coupling of the support ring to the carousel base; and a template holder coupled to the rotary coupling such that the template holder is rotatable relative to the support assembly, the template holder comprising a template interface shaped to retain a template to constrain motion of the template relative to the rotatable wheel.

8. The system of claim 7, wherein the carousel base further comprises a first bat coupling hole and a second bat coupling hole;

wherein the system further comprises:

a first bat pin shaped to engage the first bat coupling hole to couple a bat to the carousel base; and a second bat pin shaped to engage the second bat coupling hole to further couple the bat to the carousel base.

9. The system of claim 1, wherein the support assembly coupling feature comprises a first support assembly hole and the rotatable wheel coupling feature comprises a first rotatable wheel hole;

wherein the support assembly further comprises a second support assembly hole;

and wherein the system further comprises:

a first bat pin shaped to engage the first support assembly hole and the first rotatable wheel hole to couple the first support assembly hole relative to the first rotatable wheel hole; and a second bat pin shaped to engage the second support assembly hole and a second rotatable wheel hole of the rotatable wheel to couple the second support assembly hole relative to the second rotatable wheel hole.

10. The system of claim 1, wherein the support assembly further comprises a resilient member positioned to exert resilient force against the template in response to urging of the template toward the rotatable wheel.

11. A system for facilitating shaping of a workpiece on a pottery wheel comprising a rotatable wheel, the rotatable wheel comprising a rotatable wheel coupling feature, the system comprising:

a support assembly comprising:

a support assembly coupling feature capable of being coupled to the rotatable wheel coupling feature such that rotation of the rotatable wheel causes rotation of the support assembly;

a rotary coupling; and a support ring positioned adjacent to the rotatable wheel when the support assembly coupling feature is coupled to the rotatable wheel; and a template holder coupled to the rotary coupling such that the template holder is rotatable relative to the support assembly, the template holder comprising a template interface shaped to retain a template to constrain motion of the template relative to the rotatable wheel;

wherein the template holder comprises an axial brace and a radial brace, wherein the template holder is secured to the support ring such that, when the support assembly coupling feature is coupled to the rotatable wheel, the radial brace extends away from the rotatable wheel and the radial brace is displaced from the rotatable wheel and extends along a diameter of the rotatable wheel.

12. A system for facilitating shaping of a workpiece on a pottery wheel comprising a rotatable wheel, the rotatable wheel comprising a rotatable wheel coupling feature, the system comprising:

a support assembly comprising:

a support assembly coupling feature capable of being coupled to the rotatable wheel coupling feature such that rotation of the rotatable wheel causes rotation of the support assembly;

a rotary coupling;

a support structure; and a support ring and a template holder comprising an axial brace and a radial brace, the template holder being coupled to the rotary coupling such that the template holder is rotatable relative to the support assembly, the template holder comprising a template interface shaped to retain a template to constrain motion of the template relative to the rotatable wheel;

wherein, when the support assembly coupling feature is coupled to the rotatable wheel, the support ring is positioned adjacent to the rotatable wheel and the support structure extends away from the rotatable wheel; and wherein the template holder is secured to the support ring and the support structure such that, when the support assembly coupling feature is coupled to the rotatable wheel, the axial brace extends away from the rotatable wheel and the radial brace is displaced from the rotatable wheel and extends along a radius of the rotatable wheel.

13. A system for facilitating shaping of a workpiece on a pottery wheel comprising a rotatable wheel, the rotatable wheel comprising a rotatable wheel coupling feature, the system comprising:

a support assembly comprising a carousel, the carousel comprising:

a carousel base comprising a support assembly coupling feature capable of being coupled to the rotatable wheel coupling feature such that rotation of the rotatable wheel causes rotation of the support assembly; and a carousel fixture;

a template; and a template holder capable of being coupled to the carousel fixture, the template holder comprising a template interface shaped to retain the template such that the template can remain stationary while the rotatable wheel rotates.

14. The system of claim 13, wherein the template comprises an adjustable depth stop that is adjustable to permit retention of the template by the template holder in any of a plurality of displacements from the rotatable wheel, wherein in each of the plurality of displacements, the template holder retains the template such that the template is not movable along a radial direction relative to the rotatable wheel;

wherein the template comprises a plate comprising a shaping edge shaped such that, in response to contact with the workpiece during rotation of the workpiece, the shaping edge defines a contour on the workpiece;

wherein the template interface comprises a radial brace extending generally radially relative to the rotatable wheel;

and wherein the radial brace comprises a radial brace slot sized to receive the plate in any of the plurality of displacements.

15. A system for facilitating shaping of a workpiece on a pottery wheel comprising a rotatable wheel, the rotatable wheel comprising a rotatable wheel coupling feature, the system comprising:

a support assembly comprising a carousel, the carousel comprising:

a carousel base comprising a support assembly coupling feature capable of being coupled to the rotatable wheel coupling feature such that rotation of the rotatable wheel causes rotation of the support assembly, wherein the carousel base comprises a discoid shape that rests on the rotatable wheel in response to coupling of the support assembly coupling feature to the rotatable wheel coupling feature;

a carousel fixture comprising:

a ring bearing that rotatably couples the template holder to the support assembly;

a support ring capable of being coupled to the carousel base; and a support structure that extends from the support ring to the ring bearing to maintain the ring bearing in an elevated position relative to the rotatable wheel in response to coupling of the support assembly coupling feature to the rotatable wheel coupling feature and coupling of the support ring to the carousel base;

a template; and a template holder capable of being coupled to the support assembly, the template holder comprising a template interface shaped to retain the template such that the template can remain stationary while the rotatable wheel rotates.

16. The system of claim 13, wherein the support assembly coupling feature comprises a first support assembly hole and the rotatable wheel coupling feature comprises a first rotatable wheel hole;

wherein the support assembly further comprises a second support assembly hole;

and wherein the system further comprises:

a first bat pin shaped to engage the first support assembly hole and the first rotatable wheel hole to couple the first support assembly hole relative to the first rotatable wheel hole; and a second bat pin shaped to engage the second support assembly hole and a second rotatable wheel hole of the rotatable wheel to couple the second support assembly hole relative to the second rotatable wheel hole.

17. A method for shaping a workpiece on a pottery wheel comprising a rotatable wheel, the rotatable wheel comprising a rotatable wheel coupling feature, the method comprising:

coupling a support assembly to the rotatable wheel by coupling a support assembly coupling feature of the support assembly to the rotatable wheel coupling feature;

supporting a template holder with the support assembly, the template holder comprising a template interface;

positioning the workpiece;

retaining a template with the template interface, the template comprising a shaping edge;

rotating the rotatable wheel to induce rotation of the support assembly and the workpiece relative to the template; and contacting the workpiece with the shaping edge to define a contour on the workpiece;

wherein the support assembly comprises a carousel comprising a carousel base and a carousel fixture, the carousel base comprising the support assembly coupling feature.

18. A method for shaping a workpiece on a pottery wheel comprising a rotatable wheel, the rotatable wheel comprising a rotatable wheel coupling feature, the method comprising:

coupling a support assembly to the rotatable wheel, wherein the support assembly comprises a carousel comprising a carousel base and a carousel fixture, the carousel base comprising the support assembly coupling feature, by coupling the support assembly coupling feature to the rotatable wheel coupling feature;

supporting a template holder with the support assembly, the template holder comprising a template interface;

positioning the workpiece;

coupling the carousel fixture to the carousel base such that the carousel fixture generally contains the workpiece;

retaining a template with the template interface, the template comprising a shaping edge;

rotating the rotatable wheel to induce rotation of the support assembly and the workpiece relative to the template; and contacting the workpiece with the shaping edge to define a contour on the workpiece.

19. The method of claim 18, further comprising coupling an item to the carousel base, wherein the item is selected from the group consisting of a mold and a bat;

wherein positioning the workpiece comprises placing the workpiece on the item.

20. The method of claim 17, wherein the template comprises an adjustable depth stop, wherein retaining the template with the template interface comprises retaining the template at a first setting of the adjustable depth stop in which the template is retained at a first displacement relative to the rotatable wheel, the method further comprising:

after contacting the workpiece with the shaping edge, moving the adjustable depth stop to a second setting in which the template is retained at a second displacement relative to the rotatable wheel;

wherein the second displacement is different from the first displacement;

wherein the template comprises a plate comprising the shaping edge;

wherein the template interface comprises a radial brace extending generally radially relative to the rotatable wheel, the radial brace comprising a radial brace slot;

and wherein retaining the template with the template interface comprises inserting the plate into the radial brace slot.

* * * * *